US008807509B2

(12) United States Patent
Swanepoel

(10) Patent No.: US 8,807,509 B2
(45) Date of Patent: Aug. 19, 2014

(54) SECURING DEVICE

(75) Inventor: Adriaan Retief Swanepoel, Pretoria (ZA)

(73) Assignee: Inventeq Technologies, Pretoria (ZA)

( * ) Notice: Subject to any disclaimer, the term of this patent is extended or adjusted under 35 U.S.C. 154(b) by 1190 days.

(21) Appl. No.: 11/989,539

(22) PCT Filed: Jul. 26, 2006

(86) PCT No.: PCT/IB2006/052561

§ 371 (c)(1),
(2), (4) Date: Feb. 27, 2009

(87) PCT Pub. No.: WO2007/013035

PCT Pub. Date: Feb. 1, 2007

(65) Prior Publication Data

US 2009/0211066 A1 Aug. 27, 2009

(30) Foreign Application Priority Data

Jul. 28, 2005 (ZA) ..... 2005/06058

(51) Int. Cl.
*A47G 1/17* (2006.01)
*A47G 1/06* (2006.01)

(52) U.S. Cl.
USPC ..... 248/467; 248/683; 248/205.3; 248/470; 248/489; 248/691; 248/479; 248/222.52; 248/222.51; 248/208; 248/339; 248/304; 40/702; 40/751; 40/760

(58) Field of Classification Search
USPC ..... 248/323, 467, 683, 205.3, 470, 489, 248/691, 479, 222.52, 222.51, 308, 294.1, 248/339, 217.4, 493, 206.1, 206.3, 206.4, 248/304; 40/107, 702, 751, 760
See application file for complete search history.

(56) References Cited

U.S. PATENT DOCUMENTS 3,966,157 A * 6/1976 Corral et al. ..... 248/217.3
4,605,292 A * 8/1986 McIntosh ..... 359/870
4,678,150 A * 7/1987 Newman et al. ..... 248/205.3

(Continued)

FOREIGN PATENT DOCUMENTS

DE 86 25 361.1 12/1986
DE 8625361.1 12/1986

(Continued)

OTHER PUBLICATIONS

International Search Report dated Dec. 22, 2006 issued in International Application No. PCT/IB2006/052561.

(Continued)

*Primary Examiner* — Terrell McKinnon
*Assistant Examiner* — Christopher Garft
(74) *Attorney, Agent, or Firm* — Finnegan Henderson Farabow Garrett & Dunner LLP

(57) ABSTRACT

The invention provides a securing device for use in securing an object to a supporting surface, and/or for restraining an object relative to a supporting surface. The securing device includes a base (20) having a loading region (28) to which a force is applied by the object. The securing device also includes a first securing member (30) and a second securing member (50) for securing the base to the supporting surface, the base (20) pivotably engaging the first securing member (30) in order for the base to be able to transmit a force to the first securing member substantially without inducing a moment about the first securing member.

26 Claims, 9 Drawing Sheets

(56) References Cited

U.S. PATENT DOCUMENTS

| | | | | |
|---|---|---|---|---|
| 4,896,855 | A * | 1/1990 | Furnish | 248/206.3 |
| 5,890,688 | A * | 4/1999 | Riordan | 248/205.3 |
| 6,001,471 | A * | 12/1999 | Bries et al. | 428/343 |
| 6,106,937 | A * | 8/2000 | Hamerski | 428/343 |
| 6,406,781 | B1 * | 6/2002 | Hamerski | 428/317.3 |
| 6,585,205 | B2 * | 7/2003 | Beaty et al. | 248/218.1 |
| 6,641,106 | B2 * | 11/2003 | Beaty et al. | 248/475.1 |
| 6,835,452 | B1 * | 12/2004 | Hamerski | 428/343 |
| 6,854,852 | B1 * | 2/2005 | Zadro | 359/840 |
| 2003/0071182 | A1 | 4/2003 | Beaty et al. | |
| 2004/0217249 | A1 * | 11/2004 | Eisenbraun | 248/323 |

FOREIGN PATENT DOCUMENTS

| | | | |
|---|---|---|---|
| DE | 10 2004 030 252 | A1 | 1/2006 |
| EP | 0 990 404 | A2 | 4/2000 |
| EP | 0 990 404 | A2 | 4/2002 |
| GB | 2 373 287 | A | 9/2002 |
| GB | 2373287 | A | 9/2002 |

OTHER PUBLICATIONS

International Preliminary Report on Patentability dated Nov. 19, 2007.

International Search Report dated Dec. 22, 2006.

* cited by examiner

SECURING DEVICE

FIELD OF THE INVENTION

This invention relates to a securing device and more particularly, but not exclusively, to a securing device suitable for use in removably securing objects to a supporting surface.

BACKGROUND TO THE INVENTION

The need often arises to secure objects such as paintings, fittings, decorative articles and the like to vertical surfaces such as walls. Many securing devices have been proposed to satisfy this demand, with a common requirement of such devices being sufficient and reliable load bearing capacity.

A typical prior art securing device includes a hook or other engagement formation that extends from a base, the base being securable to the supporting surface on which the securing device is mounted. The base and hook is often integrally formed, but the hook may also be attached to a flexible adhesive-bearing sheet. An object as described above is then suspended from the hook, thus imparting a downward gravitational force on the hook. The point of contact between the hook and the suspended object is usually spaced apart from the base, and more particularly from a securing surface of the base. The distance between the securing surface of the base and the point where the downward force is imparted results in a moment being induced about the securing surface of the base. The moment about the base translates into forces, perpendicular to the supporting surface, being exerted on the base. At the operatively upper end of the base the force is directed away from the supporting surface, thus constituting a tensile force, whereas the force at the operatively lower end of the base is directed towards the supporting surface, thus constituting a compressive force.

In many instances a load applied to the hook or engagement formation is not parallel relative to the base of the securing device, and may for instance be directed at an angle, away from the supporting surface. In this case the exerted force will be in the form of a force vector having both vertical and horizontal components. The horizontal component of this force vector will then also contribute to the tensile forces exerted on the base.

It will be appreciated that due to the above configurations, an adhesive medium used to secure the base to the supporting surface, and more particularly an adhesive film located on the adhesive medium, is exposed to tensile stress due to the tensile force at the upper end of the base, as well as shear stress due to the gravitational force. This combination of forces adversely affects the load capacity of the adhesive medium, which is substantially lower than it would be it the adhesive medium were exposed to pure tension or pure shear.

Some solutions have been proposed to alleviate this problem, as is for instance disclosed in Dutch patent NL1028204 in the name of Peer Schoofs te Gemert ("Gemert Patent"). The Gemert patent shows a securing device having a first securing member in the form of a pin to be inserted into a wall, or into a gap between adjacent tiles, and a second securing member in the form of an adhesive member. The aim of the securing device is to prevent the adhesive member from being loaded in shear, but in order to achieve the same the pin must either be secured in the wall, or located in an aperture provided in the wall. It will be appreciated that it is often not desirable and/or practical to make an aperture in a wall or other supporting surface. Furthermore, existing apertures, such as the gap between adjacent tiles, usually do not exist. Also, if the pin is secured in the wall as envisaged in the Gemert patent, a moment and large local forces will be induced in the wall surface about the pin, which may very likely damage the wall surface. In use, the outcome of resultant forces on the two securing members is quite unpredictable, depending entirely on the nature of the securing surface. Similar disadvantages are foreseen insofar as the securing devices disclosed in CH670366 Freimann and GB2373287 Story are concerned.

Many other securing devices, including those disclosed in DE8625361 Pagenberg, DE9108687 Westphal, DP29821567 Pagenberg and U.S. Pat. No. 2,724,568 Rabinovitch, have been proposed wherein the securing device includes more than one adhesive securing member. However, in none of these cases is the securing device configured for tensile and shear forces to be separated, in order for each securing member only to be exposed to tensile or shear stresses.

The problem of reduced load capacity is further exacerbated by the presence of peel loading and cleavage loading, which are described, and for the purposes of this specification defined, below.

Peel loading typically occurs when the following conditions apply:

- The adhesive medium is carried by a base that is relatively flexible in bending;
- The base is subjected to a tensile force in a direction away from the surface to which it is bonded, i.e. there is a force component normal to the surface;
- The backing is sufficiently flexible in bending to bend under the tensile force; and
- The base is stronger in tension than the peel strength of the adhesive bond.

Under these conditions, the energy transmitted by the base as a result of the tensile force is focussed on a line of high stress at the location where the backing is separating from the surface. The applied force is focussed on this single bonding line, thus resulting in high-energy concentration, and adhesive failure in a progressive manner.

Cleavage is somewhat similar to peel, but occurs when the base is relatively rigid, so as not to bend or flex perceptibly under the applied loading. However, a tensile force component normal to the surface is still present, and cleavage occurs when this tensile force is not uniformly distributed over the bond area under the backing. Moreover, cleavage loading situations are characterised in that the backing is usually not completely parallel to the surface to which it is bonded, or it is not constrained to remain parallel. As a consequence of the non-uniform distribution of the pulling force or the non-parallel orientation or both, there will be places where the tensile stress in the adhesive bond peaks at its highest value. If the tensile stress exceeds the local adhesive bond strength at any point, the adhesive bond may fall at that point and run in a progressive manner through the entire adhesive bond under the rigid backing. In structures under static loading, once localised failure in the adhesive bond has started, the stress in the remaining adhesive bond increases, since progressively less bonded area remains to bear the load. Cleavage failure therefore typically starts off slowly and increases in tempo as failure progresses.

It is clear from the above that cleavage and peel loading are undesirable where a durable adhesive bond is required. For maximum strength, cleavage and peel loading should thus be avoided as far as possible. If there is any possibility that a peel or cleavage process may occur in a product where adhesive bond strength is important, such a product may be prone to premature failure.

In addition to the need for high load bearing capacity, it is also preferable for a securing device to be easily removable from a surface on which it has been mounted, without damaging such surface. The well-known standard double-sided tape, comprising a backing material having adhesive films on opposing surfaces thereof, is often used as an adhesive medium for securing devices. However, removal of standard double-sided tape often proves to be troublesome because the backing material of the double-sided tape, usually comprising an elastomeric foam, tends to tear or break, thus preventing the double-sided tape from being removed as an intact section of tape. In addition, the bond between the double-sided tape and the supporting surface is often strong enough to result in the supporting surface being damaged when the securing device mounted by double-sided tape is pulled from the supporting surface.

Several patents, including U.S. Pat. No. 5,409,189 Luhmann, U.S. Pat. No. 5,984,247 Luhmann, U.S. Pat. No. 5,989,708 Kreckel and U.S. Pat. No. 6,001,471 Bries, disclose the use of so-called stretch release doublesided tape in providing removable securing devices. Stretch release double-sided tape is a special type of double-sided tape, and is commercially available from companies such as Beiersdorf AG and 3M. Stretch release double sided tape involves the progressive, controlled destruction of the adhesive bond on both adhesive sides of the double-sided tape when the tape is firmly pulled at one end of the tape along its length. As the tape material stretches, the adhesive bond is broken in progressive manner until the tape is fully stretched and the adhesive bond completely broken, thus releasing the securing device from the wall.

However, stretch release tapes are beset with numerous problems, which are inter alia documented in the above patent specifications. A first problem is that the backing material may tear before the adhesive bond is completely broken. When the backing material, and thus the tape, tears, it becomes almost impossible to remove the securing device without damaging the surface on which it is mounted. Ageing of the tape increases the risk of tearing, as well as excessive pressure applied by a user onto the securing device as the user holds it during removal. A further problem is that the tape may exhibit a substantial amount of recoil when the securing device is released. This recoil action may easily cause physical injury to a person trying to remove the securing device.

As described hereinbefore, some securing devices utilise an adhesive-bearing sheet that bonds the securing device to the supporting surface. The adhesive-bearing sheet typically comprises some sort of backing material having an adhesive film on at least one surface thereof. In use the adhesive-bearing sheet is, amongst others, subjected to a force component substantially parallel to the supporting surface and the adhesive-bearing sheet so as to result in a shear loading, and thus shear stress, in the adhesive bond between the adhesive-bearing sheet and the supporting surface. One problem associated with existing adhesive-bearing sheets is that the backing material is often not sufficiently rigid to ensure uniform distribution of the shear loading over the entire adhesive film, which may result in excessive stretching of the backing material, which causes non-uniform loading and thus premature failure of the adhesive bonds.

OBJECT OF THE INVENTION

It is accordingly an object of the invention to provide a securing device that will, at least partially, alleviate some of the abovementioned disadvantages, and/or to provide a useful alternative to existing securing devices.

SUMMARY OF THE INVENTION

According to the invention there is provided a securing device for use in securing an object to a supporting surface, and/or for restraining an object relative to a supporting surface, the securing device including:

a base being securable to the supporting surface, the base having a loading region to which a resultant force is applied when the object in use engages the securing device; and a first securing member and a second securing member for securing the base to the supporting surface, the base pivotably engaging the first securing member in order for the base to be able to transmit a force to the first securing member substantially without inducing a moment about the first securing member.

There is provided for the securing device to be configured for the first securing member in use to be loaded in a first direction, and for the second securing member in use to be loaded in a second direction, wherein the first direction is substantially perpendicular relative to the second direction.

Preferably, only forces substantially parallel to the first securing member are transmittable from the base to the first securing member, with no forces substantially perpendicular to the first securing member being transmittable to the first securing member.

The first securing member may be configured in use to be subjected to a force being substantially parallel to a securing surface of the first securing member. The force may induce shear stress in the securing member.

The second securing member may be configured in use to be subjected to a force being substantially perpendicular to a securing surface of the second securing member. The force may induce tensile stress in the securing member.

A first end zone of the base may pivotably engage an engagement formation provided on the first securing member. Preferably an edge of the base pivotably engages the engagement formation. The engagement formation may be located towards an end of the first securing member.

The edge of the base and the engagement formation may be complimentary shaped to enable one to pivotably locate within the other. Preferably the engagement formation is in the form of a fold provided in the end of the first securing member, the edge of the base being secured in the fold. Alternatively, the engagement formation may be in the form of a socket formation extending from the first securing member, the edge of the base defining a spigot that pivotably engages the complimentary shaped socket.

The first securing member may include a displacement zone that divides the first securing member into a primary section and a secondary section, the displacement zone being adapted to prevent displacement of the primary section from being transmitted to the secondary section.

The displacement zone may be in the form of a pleat provided in the first securing member. Alternatively the displacement zone may be in the form of a weakened section comprising a plurality of perforations. There is also provided for the primary section and the secondary section to be two independent sections being interconnected by means of a bridging member.

The first securing member may also include guiding means for in use assisting a user correctly to orientate the securing device on the supporting surface. The guiding means may be in the form of apertures in the first securing member, and more particularly in the form of triangular notches in an outer edge of the first securing member.

The first securing member may further include splitting formations allowing the first securing member to be split into a number of sections when the first securing member is removed from the supporting surface. The splitting formations may be in the form of linear perforations or slits.

The first securing member may comprise a section of sheet material having an adhesive lamination, alternatively double-sided adhesive tape, alternatively bonded adhesive tape, provided on a surface thereof.

In an alternative embodiment the first securing member may at least partially include a high-friction surface, which surface provides sufficient friction between the first securing member and the supporting surface to prevent the high-friction surface from being displaced relative to the supporting surface when in use. The high-friction surface may comprise sandpaper, rubberised material, silicon, a sheet with protruding spikes or nodules, or any other suitable configuration. There is also provided for the entire first securing member to have a high-friction surface.

Preferably the first securing member is of the type as described hereinbelow.

There is provided for the second securing member to be connected to the base in a configuration wherein a resultant force component in the second direction is transmitted to the second securing member.

A second end zone of the base may be substantially parallel relative to the supporting surface, the second securing member being connected to the second end zone of the base. The second securing member may directly be connected to the base, and alternatively a rigid connection may be provided between the second securing member and the base. Alternatively the second securing member may be connectable to the base by means of an elongate flexible member being substantially rigid in tension.

The second securing member may comprise a backing section having adhesive films provided on opposite sides thereof. More particularly, the second securing member may be in the form of double-sided tape.

The second securing member may also include guiding means for in use assisting a user correctly to orientate the securing device on the supporting surface. The guiding means may be in the form of apertures in the second securing member, and more particularly in the form of triangular notches in an outer edge of the second securing member.

Preferably the second securing member is of the type as described hereinbelow.

The first securing member and the second securing member may be spaced apart when mounted on the supporting surface.

Alternatively the second securing member may overlie the first securing member in a configuration wherein the second securing member is mountable on the first securing member and the first securing member is mountable on the supporting surface. More particularly, the second securing member may be mountable on the secondary section of the first securing member.

The loading region may include a receiving formation for receiving the object, and alternatively may include attachment means for attaching the object and the base to one another.

There is further provided for the receiving formation to be located towards the second end zone of the base.

Alternatively the receiving formation may be located towards the first end zone of the base.

The receiving formation may extend from the base, and may be in the form of a hook, a knob, a rigid loop, a flexible loop, a receiving slot complimentary dimensioned to an engagement formation on an object to be received, or any other suitable formation that extends from the base. Alternatively, the receiving formation may be in the form of an aperture provided in the base. Alternatively the receiving formation may be defined by an operatively upper edge of the base.

According to a further aspect of the invention there is provided a securing device for use in securing an object to a supporting surface, and/or for restraining an object relative to a supporting surface, the securing device including:

a base being securable to the supporting surface, the base having a loading region to which a resultant force is applied when the object in use engages the securing device; and the base being securable to the supporting surface by way of a first securing member and a second securing member, wherein the first securing member in use is loaded in a first direction, and the second securing member in use is loaded in a second direction, the first direction being substantially perpendicular relative to the second direction;

the securing device characterised therein that both the first securing member and the second securing member are adhesively secureable to the supporting surface.

Preferably the base pivotably engages the first securing member in order for the base to be able to transmit a force to the first securing member substantially without inducing a moment about the first securing member.

According to a further aspect of the invention there is provided a securing device for use in securing an object to a supporting surface, and/or for restraining an object relative to a supporting surface, the securing device being mounted to the support surface and including:

a base having a loading region to which a resultant force is applied when the object in use engages the securing device, the base being secured to the supporting surface by way of a first securing member and a second securing member, wherein the first securing member in use is loaded in a first direction, and the second securing member in use is loaded in a second direction, the first direction being substantially perpendicular relative to the second direction;

the securing device characterised therein that both the first securing member and the second securing member are adhesively secured to the supporting surface.

Preferably the first securing member and the second securing member are substantially in the same plane.

Preferably the base pivotably engages the first securing member in order for the base to be able to transmit a force to the first securing member substantially without inducing a moment about the first securing member.

According to a further aspect of the invention there is provided a first securing member, suitable for use in a securing device as described hereinbefore, the first securing member including a body and an adhesive film located on the body, the first securing member being characterised in that the distance with which the body stretches when a force, resulting from a maximum design load, is applied in a direction parallel with the adhesive film, is smaller than a thickness of the adhesive film.

Preferably the distance with which the body stretches will be less than half the thickness of the adhesive film. More preferably the distance with which the body stretches will be less than a quarter of the thickness of the adhesive film.

According to a still further aspect of the invention there is provided a second securing member, suitable for use in a securing device as described hereinbefore as well as other applications, the second securing member including:

a body;

at least one backing sheet located on a surface of the body;

an adhesive medium located on a surface of the backing sheet opposite the body;

the second securing member characterised therein that the backing sheet has a Young's modulus of at least 1000 MPa (mega Pascal).

Preferably the backing sheet has a Young's modulus of at least 2000 MPa (mega Pascal).

Most preferably the backing sheet has a Young's modulus of at least 5000 MPa (mega Pascal).

According to a still further aspect of the invention there is provided a method of removing the securing device, as described hereinbefore, from a supporting surface, the method including the steps of:

providing a cutting device being sufficiently flexible so as to be insertable between the supporting surface and the base without imparting a substantial force on the base; and forcing the cutting device into the body of the second securing member so as to split the body by cutting therethrough, so as to allow the body to be removed from the supporting surface.

The method may also include the step of removing the backing sheet of the second securing member after the body has been removed.

The backing sheet may be removed by peeling the sheet from the supporting surface.

The backing sheet may be adapted to be peelable into a plurality of separate elongate strips.

According to a further aspect there is provided a flexible cutter, suitable for cutting through a body of a securing member, the cutter being sufficiently flexible so as to be insertable between a supporting surface and an object held by the securing member without imparting a substantial force on the object.

The securing member may be a second securing member of the invention as described hereinbefore.

BRIEF DESCRIPTION OF THE DRAWINGS

Preferred embodiments of the invention are described by way of non-limiting examples, and with reference to the accompanying drawings, in which.

DETAIL DESCRIPTION OF THE INVENTION

Figure 1:
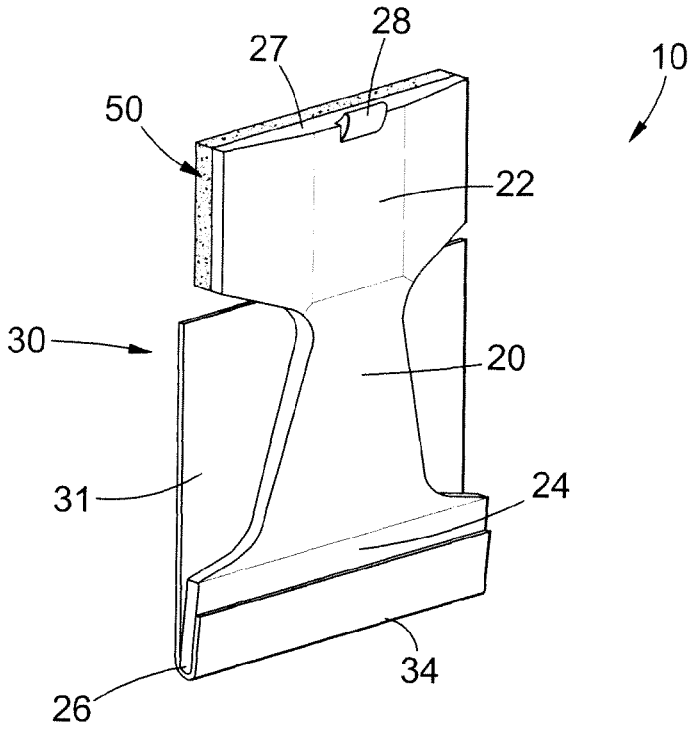
FIG. 1 is a perspective view of a first embodiment of the securing device in accordance with the invention.

Referring to the drawings, in which like numerals indicate like features, embodiments of the invention will now be described by way of non-limiting examples, in which a securing device is generally indicated by reference numeral 10.

Figure 2:
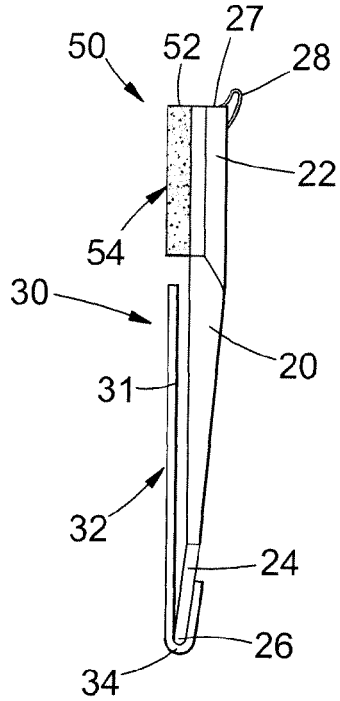
FIG. 2 is a side view of the securing device of FIG. 1.
Figure 3:
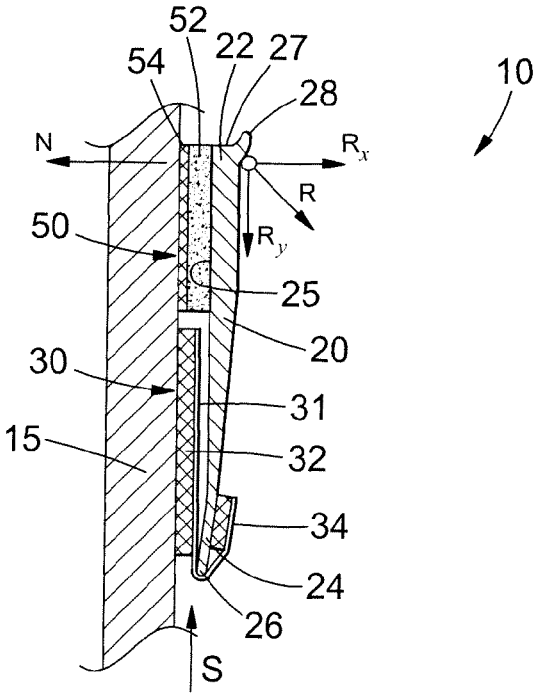
FIG. 3 is a schematic representation of the securing device of FIGS. 1 and 2, the securing device being mounted on a supporting surface.

The securing device, as shown in FIGS. 1 to 3, comprises a base 20 that is mountable on a supporting surface 15. The base 20 has a loading region, typically in the form of a receiving formation 28 for receiving the object or alternatively attachment means for attaching the object, where a loading force is applied to the base when in use an object (not shown) is mounted on the supporting surface 15 by the securing device 10. The securing device also includes a first securing member 30 and a second securing member 50 and is configured such that a first component of the resultant force (Ry) is exerted on the first securing member 30 and is substantially perpendicular to a second component (Rx) of the force exerted on the second securing member 50. This distribution of force components results in the fist securing member 30 to be loaded in shear (S) and the second securing member 50 to be loaded in tension (N). The base 20 is pivotably connected to the first securing member 30 so as to transmit a force to the first securing member 30 substantially without inducing a moment about the first securing member 30. A compressive force, directed substantially perpendicular to the supporting surface 15, may be exerted on the first securing member 30 by the base 20, and more particularly by the pivot point or fulcrum of the base 20. The compressive force may not be distributed to the rest of the first securing member 30, and may remain a local force focused on the area where the pivot point or fulcrum of the base 20 engages the supporting surface 15. It should be noted that compressive forces are not of concern from a load bearing and reliability point of view, as long as there are no oppositely directed tensile forces present.

The base 20 is generally planar and includes an operatively upper end 22 as well as an operatively lower end 24. The base 20 can be of many different configurations, depending on the particular embodiment of the securing device 10. However, in the specific embodiments depicted in the specification the base 20 includes a receiving formation 28 as well as an edge 26 suitable for pivotably engaging the first securing member 30.

Figure 8:
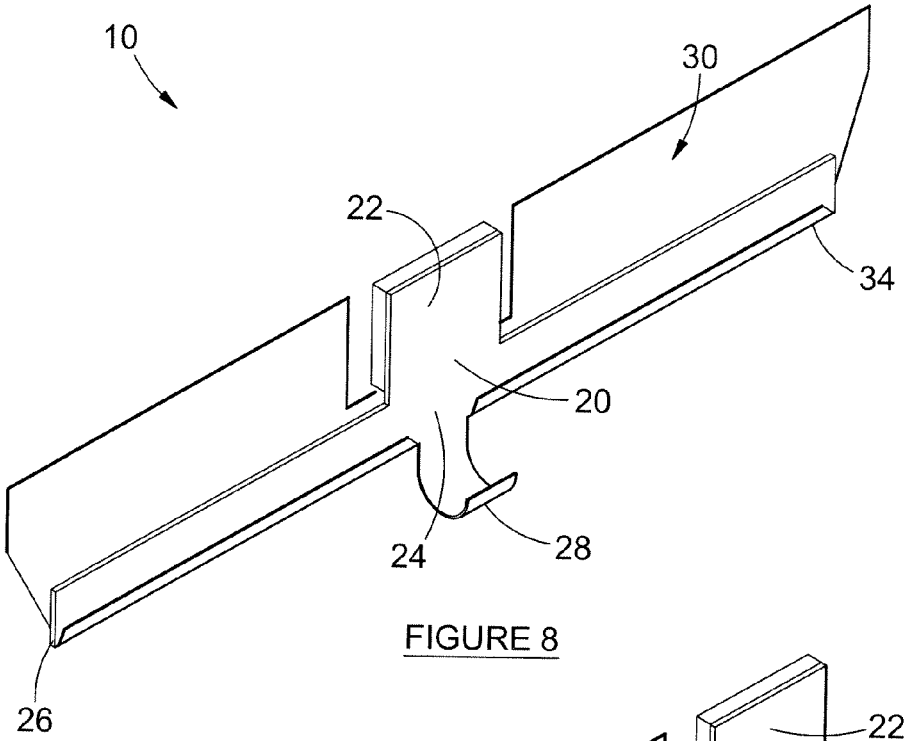
FIGS. 8 to 11 are perspective views of different configurations of a fifth and sixth embodiment of the invention.
Figure 12:
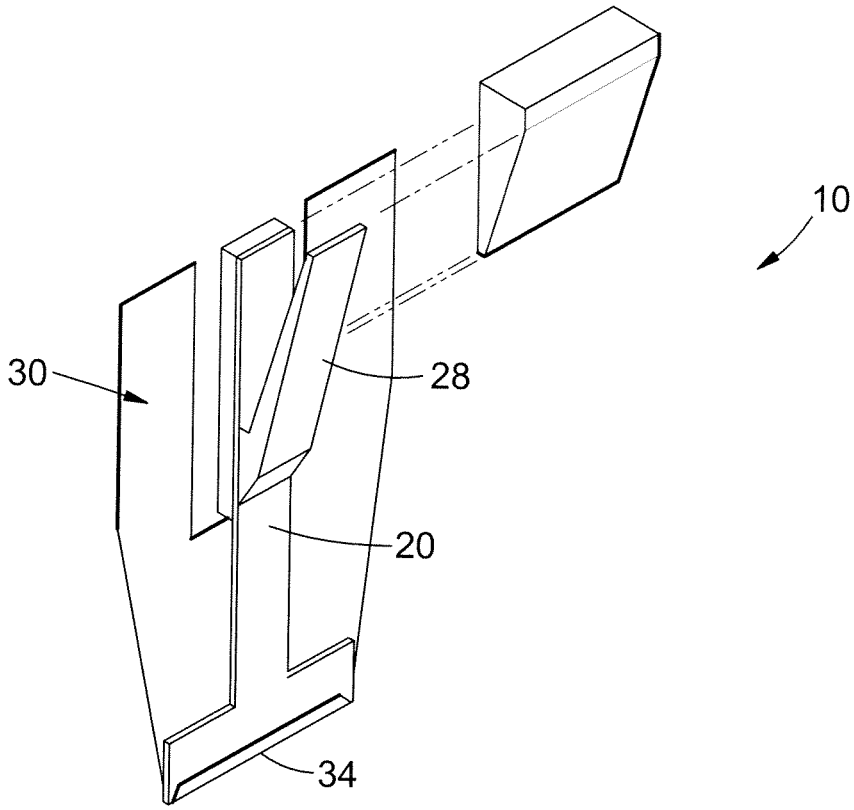
FIGS. 12 to 14 are perspective views of alternative receiving formations suitable for use in any of the embodiments of the invention.
Figure 13:
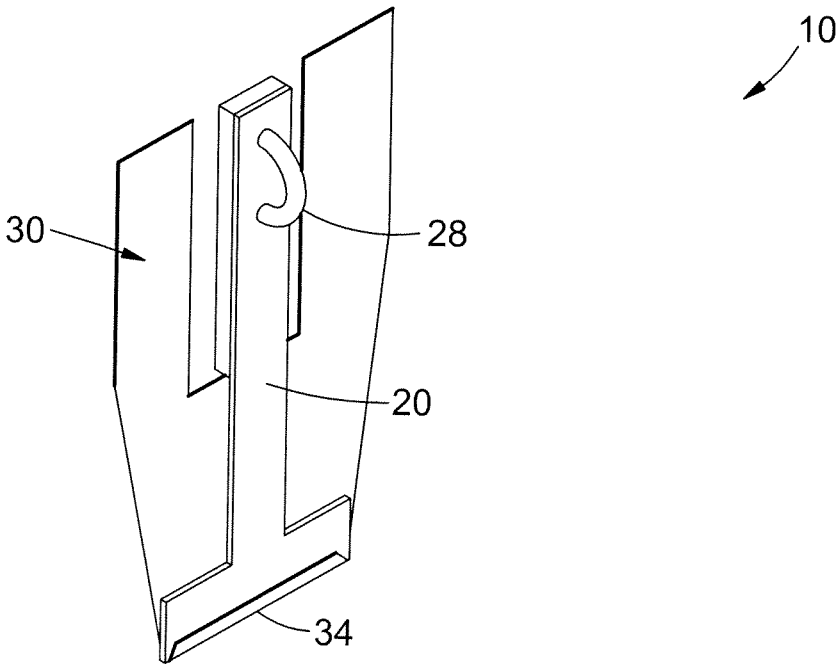
Figure 14:
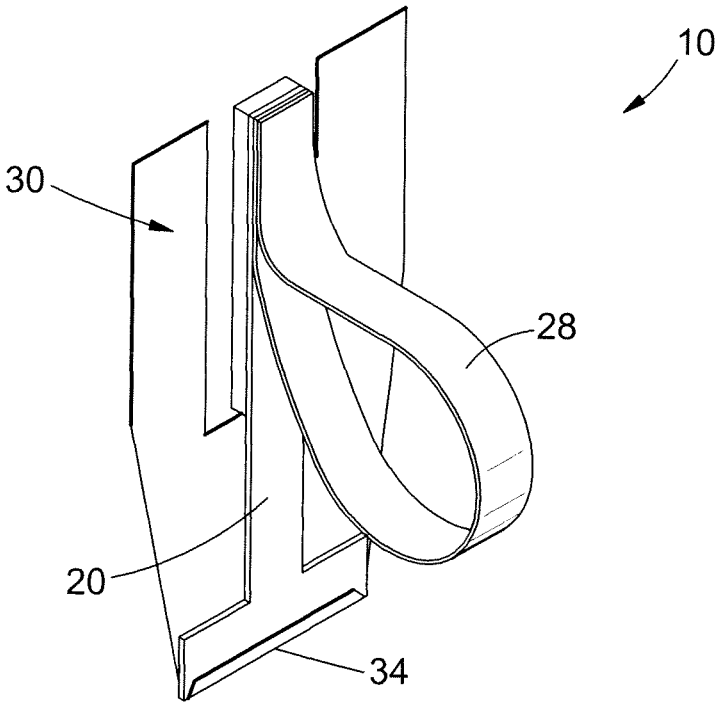
Figure 15:
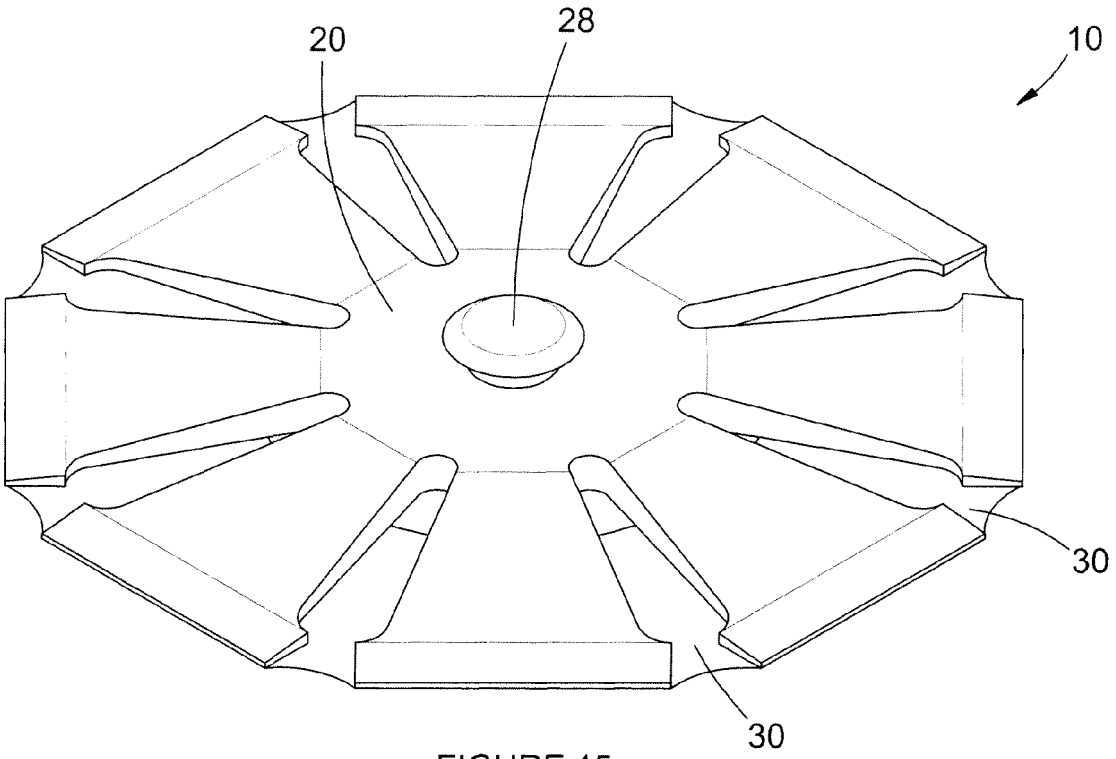
FIGS. 15 and 16 show still further embodiments of multi-directional securing devices in accordance with the invention.
Figure 16:
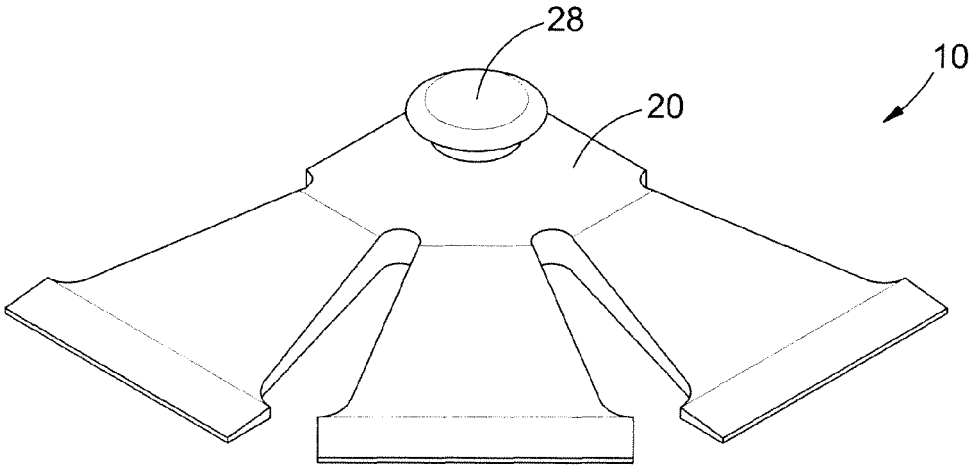

The receiving formation 28 can be of many different variations. In FIG. 1 the receiving formation is in the form of a hook-like extension extending from the upper end 22 of the base 20. FIG. 8 shows a different embodiment wherein a hook-like formation extends from a lower end 24 of the base. Other embodiments include an extension profiled complimentary to an object to be secured as seen in FIG. 12, a rigid loop as seen in FIG. 13, a flexible loop as shown in FIG. 14 as well as a knob-formation as shown in FIGS. 15 and 16. It will also be appreciated that an upper edge 27 of the base can also be used as receiving formation when the object to be secured (not shown) has a hook formation extending therefrom.

The securing device 10 includes a first securing member 30, with the base 20 and the first securing member 30 being pivotably connected. Referring to FIGS. 2 and 3, the first securing member 30 includes a body 31 in the form of a planar section of sheet material, and an adhesive medium 32 located on a surface of the body 31. The adhesive medium 32 can be in the form of double-side tape as shown in FIG. 3, but it can also be in the form of a thin adhesive film or lamination provided on a surface of the sheet-like body 31 of the first securing member.

Figure 7:
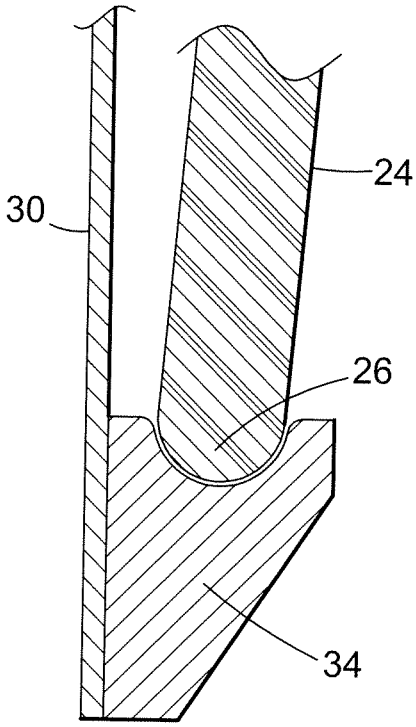
FIG. 7 is a side view of an alternative engagement formation for use in any embodiment of the invention.

The first securing member 30 is adapted to pivotably engage the base 20, and more particularly a lower edge 26 of the base. In FIG. 3 a lower end of the sheet-like body 31 defines an engagement formation 34. The lower end is folded back and attached to the base, in order for the lower edge 26 of the base 20 to locate in the elongate channel so formed, thus providing a pivotable connection. In a further embodiment shown in FIG. 7 the engagement formation 34 is in the form of a receiving formation extending from a lower end of the first securing member 30. The receiving formation includes an aperture of semi-circular profile being complimentary shaped to the lower edge 26 of the base, thus allowing the base to pivot in the aperture. In the particular embodiment the aperture is located in the receiving formation, but it will be appreciated that the inverse would also suffice. It will be appreciated that the pivotable connection between the base and the first securing member 30 may take many other forms, but the overriding principle is that the base 20 is connected to the first securing member 30 in such a way that a downward force is transmitted without inducing a moment about the first securing member 30.

Figures 4, 4A, 4B, 4C:
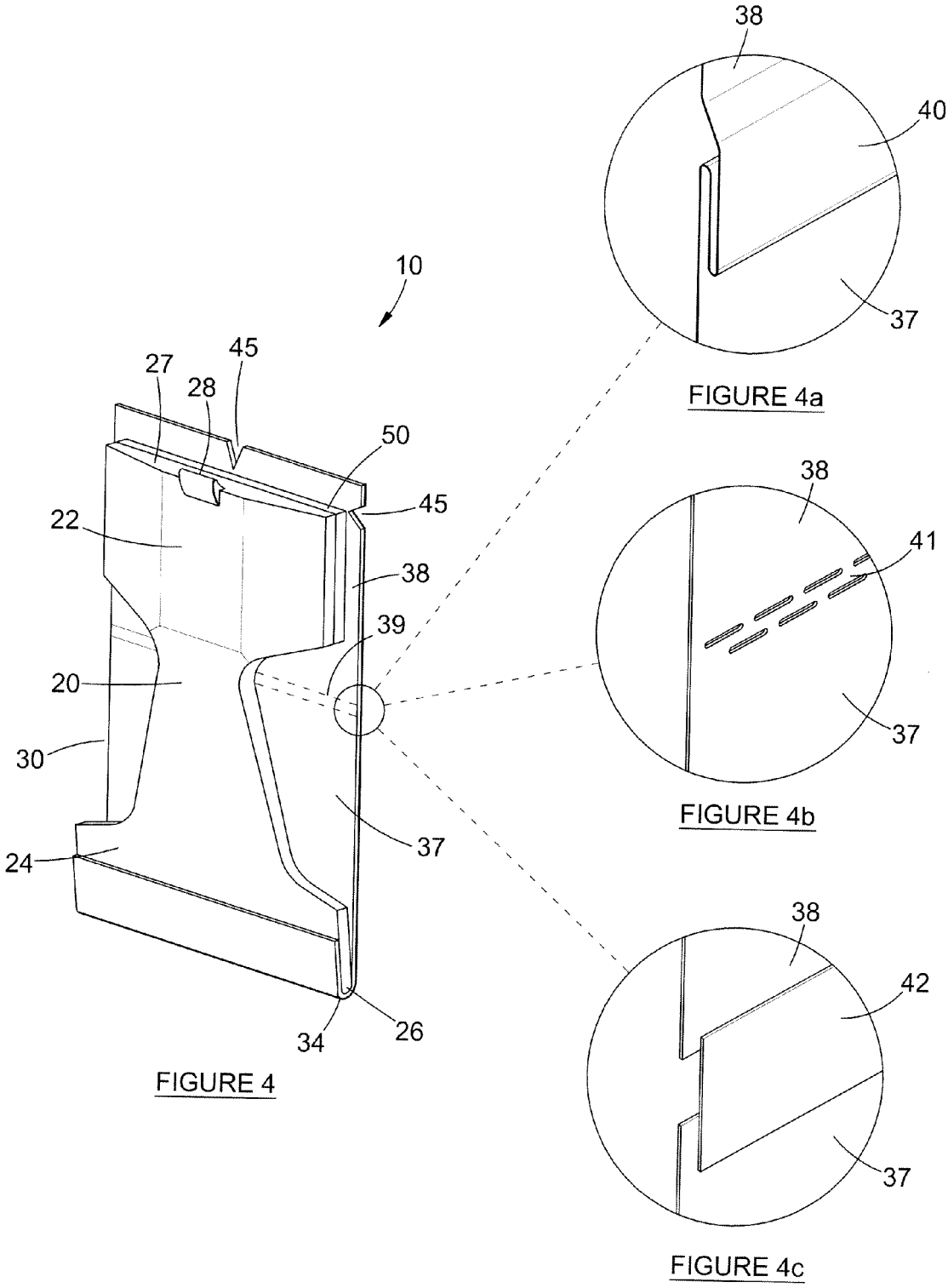
FIG. 4 is a perspective view of a second embodiment of the securing device in accordance with the invention, with different configurations of a displacement zone of the securing device shown in FIGS. 4*a* to 4*c;*

For reasons that will become apparent later on, the first securing member 30 may also include a displacement zone 39 as shown in FIG. 4. The displacement zone 39 divides the first securing member in a primary section 37 and a secondary section 38, and allows the primary section 37 to be displaced without the displacement being carried over to the secondary section 38. A downward shearing force imparted on the primary section 37 will thus not be conveyed to the secondary section 38. The displacement zone 39 may adopt many different configurations such as a pleat 40 formed in the first securing member as shown in FIG. 4*a* or a plurality of perforations 41 forming a weakened zone as shown in FIG. 4*b*. Alternatively, as shown in FIG. 4*c*, the primary section 37 and the secondary section 38 of the first securing member may be separate from one another, and a bridging member 42 may connect the two sections so as to define the displacement zone 39.

Figure 11:
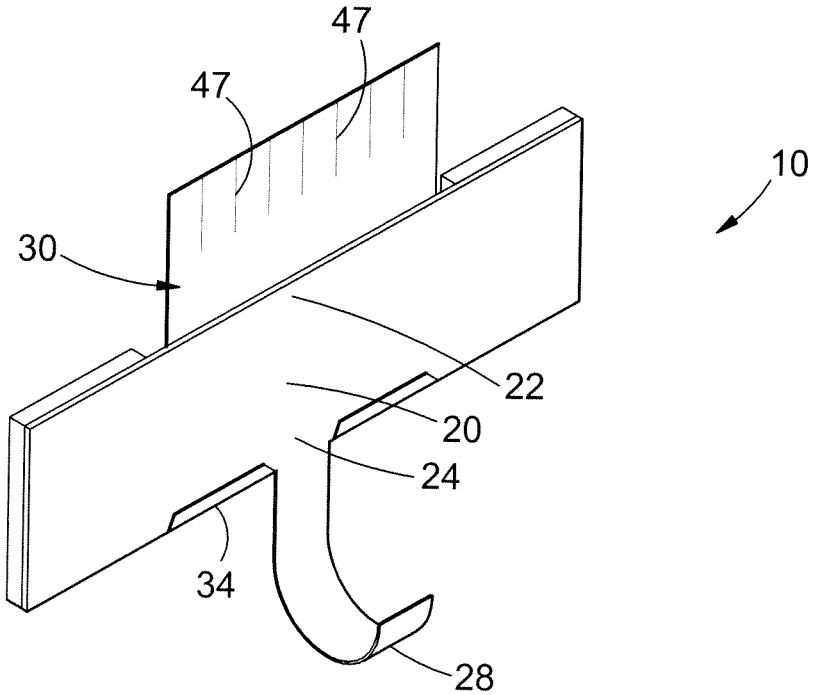

The first securing member 30 may furthermore include guiding means 45 for assisting a user to correctly orientate the securing device 10 when the device is mounted on a supporting surface 15. In this embodiment the guiding means 45, shown in FIG. 4, is in the form of triangular apertures or notches provided in edges of the first securing member 30. The first securing member may furthermore include splitting formations 47 as shown in FIG. 11. The splitting formations 47, in this embodiment in the form of linear slits, assist a user to tear the first securing member 30 into separate strips when the securing device 10, and more particularly the first securing member 30 is removed form the supporting surface 15. Alternatively, the first securing member may utilise an adhesive being formulated to be removable without being destroyed during removal, and thus also to be reusable. The first securing member may for instance be peeled from the supporting surface by pulling at an edge of the securing member. In this case the splitting formations 47 will not be required, as the purpose will be to remove the first securing member 30 as an intact unit that can be reused.

Figure 5:
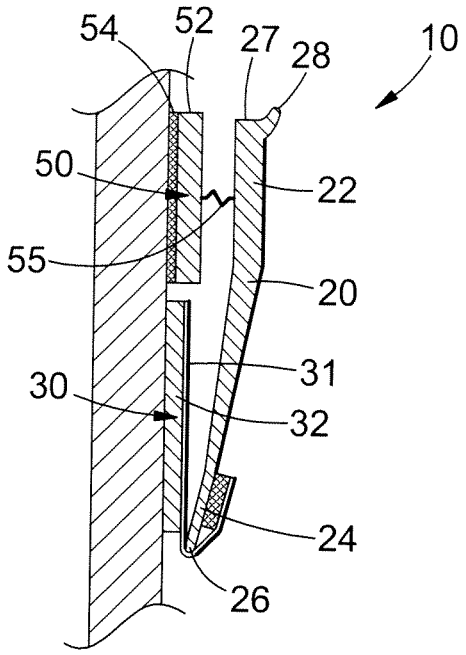
FIG. 5 is a schematic representation of a third embodiment of the securing device being mounted on a supporting surface.
Figure 6:
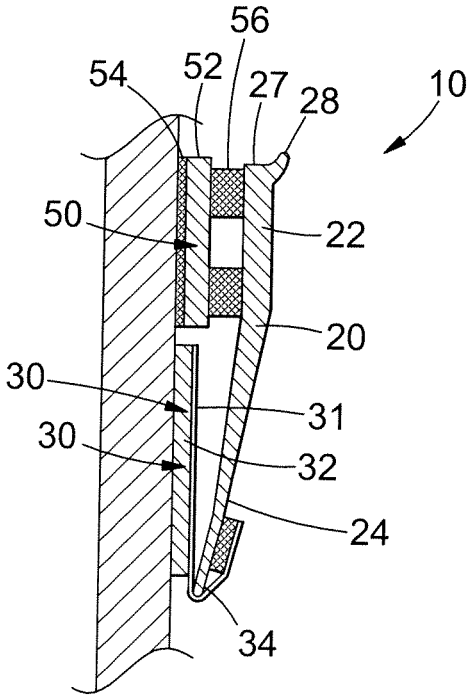
FIG. 6 is a schematic representation of a fourth embodiment of the securing device being mounted on a supporting surface.

The second securing member 50, best seen in FIG. 3, includes a body 52 having an adhesive layer 54 provided on a surface thereof. Alternatively, the second securing member 50 may be in the form of a magnet being attachable to a magnetic surface. The second securing member 50 may be connected to the base 20 in a number of ways. FIGS. 2 and 3 show the second securing member 50 being directly secured to the base, whereas FIG. 6 includes a rigid connection 56 between the second securing member 50 and the base 20. In FIG. 5 the second securing member 50 is connected or connectable to the base by means of a flexible connector 56, which is rigid in tension. The flexible connector may for instance be a chain or a cord.

The base 20, first securing member 30 and second securing member 50 may be configured in a number of ways, which all satisfy the basic requirements of this invention. A primary distinction can be made between a configuration where the first securing member 30 and the second securing member 50 are spaced apart but adjacent one another when the securing device 10 is mounted on the supporting surface 15, and a configuration where the second securing member 50 overlies and is mounted on the first securing member 30. One embodiment of the first configuration is shown in FIG. 1, wherein the first securing member 30 extends upwardly from the lower end 24 of the base 20, but ends short of the second securing member 50 that is connected to an upper end 22 of the base. In this configuration the first securing member 30 and the second securing member 50 are independently secured to the supporting surface. Further non-exhaustive embodiments of this configuration are shown in FIGS. 8 to 11 which all disclose the same basic configuration, but with different relative orientations of the first securing members 30 relative to the second securing members 50, with the base 20 also adopting the shape required to give effect to the required orientations.

An example of the second configuration is shown in FIG. 4. In this configuration the second securing member 50 is mounted on the secondary section 38 of the first securing member 30. Downward forces, and thus shear stresses, on the primary section 37 of the first securing member 30 are not carried over to the secondary section 38 of the first securing member 30, due to the displacement zone 39 allowing for displacement of the primary section 37. This configuration ensures that the secondary section 38 is not exposed to the vertical component of the force vector acting on the securing device 10, and thus remains in pure tension. An additional benefit of this configuration is that the securing device 10 can more easily be removed without damaging the supporting surface, since the secondary section provides protection to the supporting surface when the second securing member is being removed.

A further example of the second configuration involves a layout similar to that shown in FIG. 4, but wherein the second securing member 50 is secured to the first securing member 30 by means other than an adhesive, such as for example by welding. The second securing member 50 may also be integrally made with the first securing member 30. In this instance the second securing member 50 may not be readily distinguishable from the first securing member 30, but a securing device configured in this manner would still embody the invention without deviating from the fundamental principles.

In use an object (not shown) is suspended from the receiving formation 28 extending from or located in the base 20. The object exerts a loading force on the receiving formation, the composition and direction of which will vary according to the particular application. If an object is hanged from the securing device, the loading force will be predominantly gravitational, and will be directed in the direction Ry. A force in the direction Rx will also be induced due to a moment being induced about the second securing member 50 because of the receiving formation being spaced apart from the supporting surface. However, it the securing device is used to retain an object relative to a supporting surface the force may be a vector in a direction R, which will then have components in directions Rx and Ry. An additional force in the direction Rx may again be present due to the induced moment.

Irrespective of the application, it will be apparent that a resultant force R will be present, the force R having horizontal (or tensile) Rx and vertical (or shear) Ry components. These force components are substantially perpendicular, and will result in equal but opposite forces in the two securing members. A tensile force N, normal to the supporting surface, will be present in the second securing member 50, and will result in tensile stresses in the second securing member 50. The second securing member 50 will be substantially free from shear stresses, and the second securing member 50 will be subjected to pure tension. A shearing force S, parallel to the supporting surface, will be present in the first securing member 30, and will result in shear stresses in the first securing member 30. The first securing member 30 will be substantially free from tensile stresses, and the first securing member 30 will be subjected to pure shear.

Although it is not a preferred embodiment, the inventor foresees that the normal force N may be slightly angularly displaced relative to a true normal plane extending from the supporting surface. This may for instance result from use of a base having an angularly offset end section together with a wedge-shaped second securing member being locatable between the supporting surface and the angularly offset end section. Although this configuration is not optimal, it is foreseen that it will also serve the primary function of substantially separating the force vector acting on the securing device in two discreet, substantially perpendicular force components.

Figure 9:
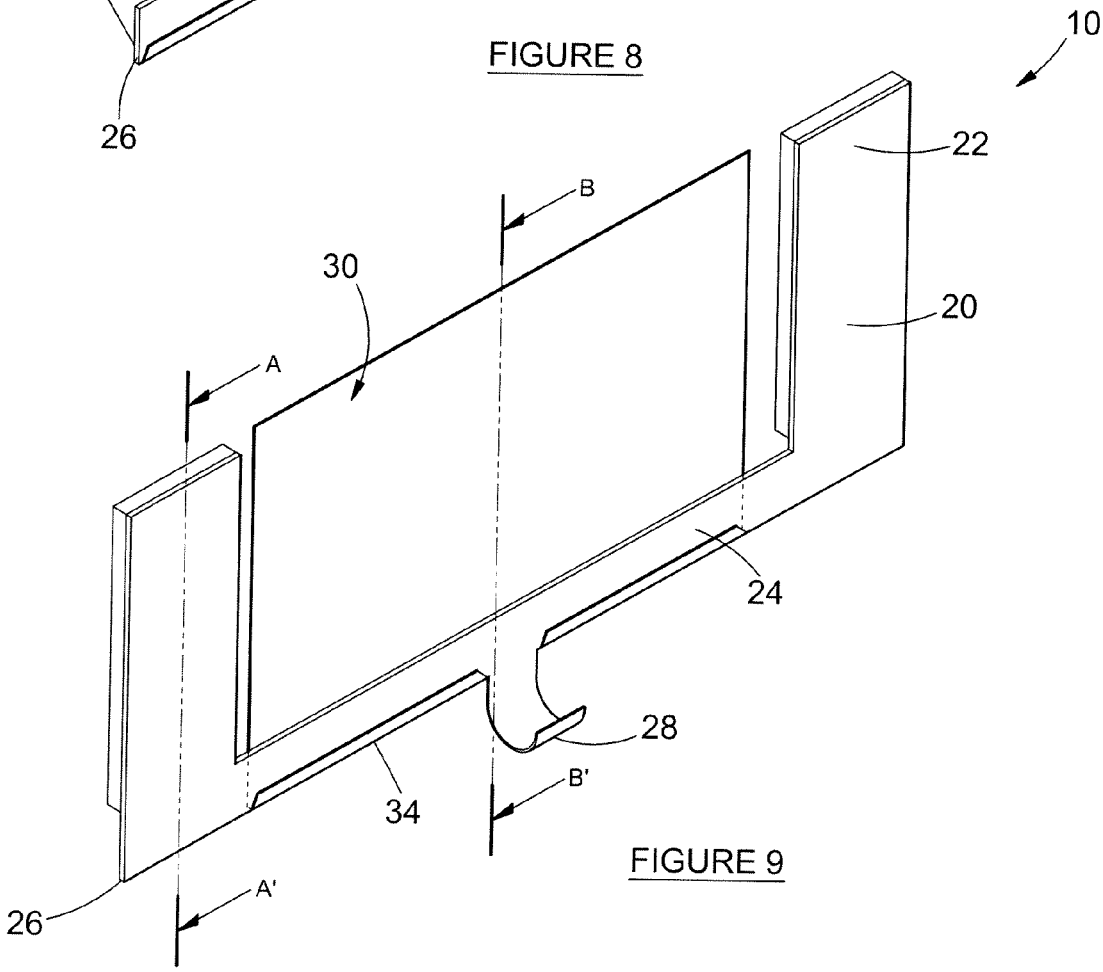
Figure 9A:
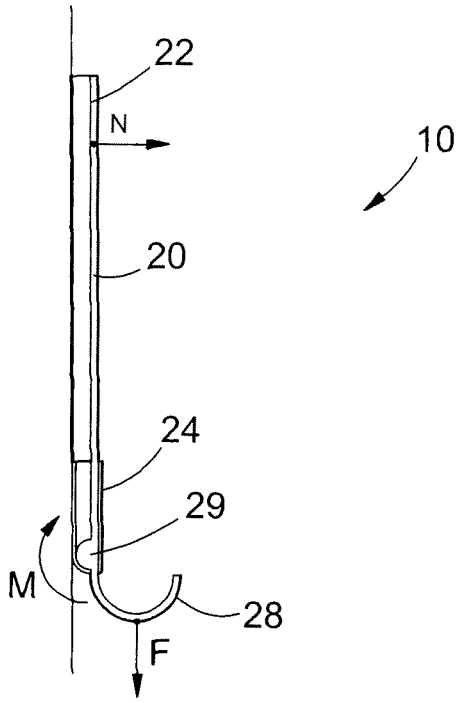
FIGS. 9*a* and 9*b* are cross-sectional side views of the securing device shown in FIG. 9, along lines AA' and BB' respectively.

In the examples shown in FIGS. 3 and 9*a* the base 20 is pivotably connected to the first securing member 30, so as to be pivotable about a fulcrum defined by a section of the base pressing against the first securing member 30 or supporting surface 15. This configuration allows for the downward or parallel force S to be carried over to the first securing member, but no moment is induced about the first securing member 30 due to the connection being freely pivotable. Also, no forces directed away from the supporting surface 15 are present. The first securing member 30 therefore only needs to oppose the downward or parallel force S, and the adhesive bond is not exposed to tensile stresses that may result in peeling of the first securing member. It will be appreciated by one skilled in the art that the most beneficial location for a fulcrum formation is typically towards or at the bottom of the base, but that the fulcrum may be located anywhere on the base provided that no moment is induced, and that no force directed away from the base is present when a load is applied to the securing device.

The upper end 22 of the pivoting base 20 is secured to the supporting surface 15 by way of the second securing member 50. Since the shear force S is borne by the first securing member, the force N exerted by the base 20 on the second securing member 50 is purely normal, and thus results only in tensile stresses in the adhesive bond of the second securing member. Importantly, an inner face 25 of the base is parallel to the supporting surface 15 so as to ensure that the second securing member only needs to oppose normal forces, and thus to prevent peel or cleavage. If the connection between the second securing member 50 and the base 20 is by way of a flexible connector 55, as shown in FIG. 5, it is not critical that the inner face 25 be parallel to the supporting surface, as long as the connector 55, when in use, is substantially normal to the second securing member 50. It will be appreciated that the base furthermore need not be as rigid in this embodiment.

Figure 9B:
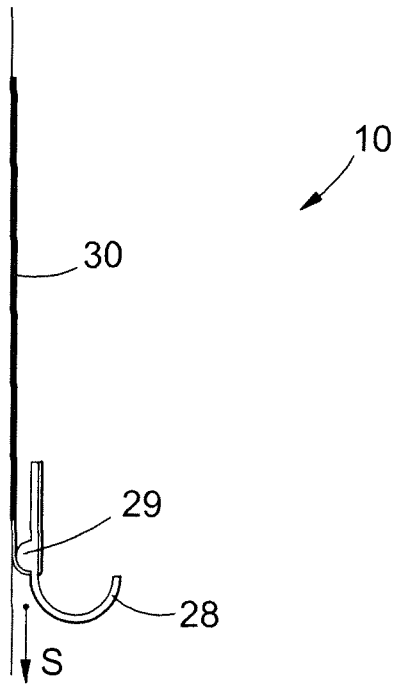
Figure 10:
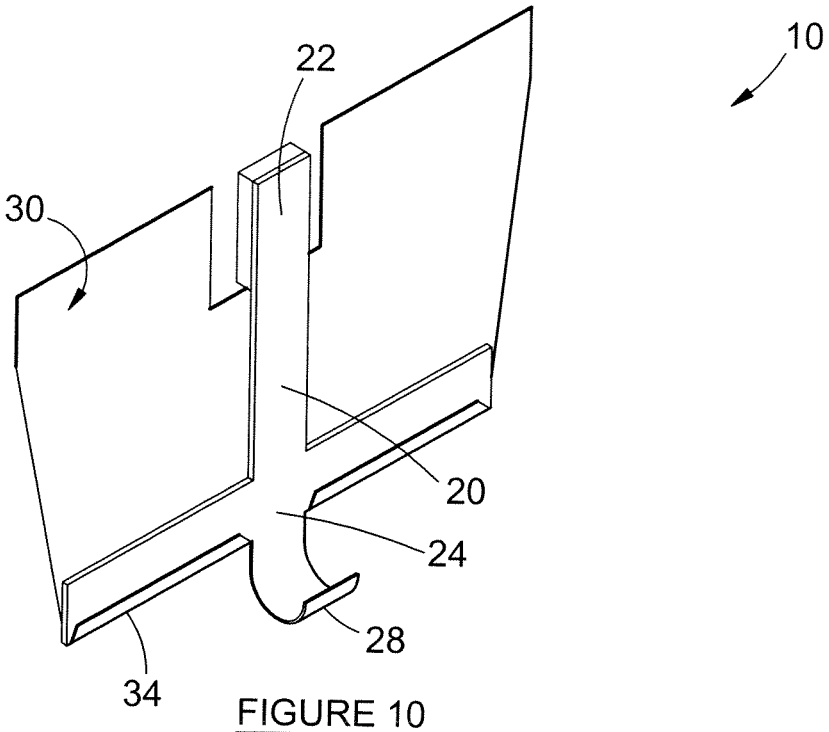

The principle remains the same irrespective of the location of the receiving formation 28 on the base 20. However, if the receiving formation is located towards the lower end 24 of the base 20, the pivot formation 29, as seen in FIGS. 9*a* and 9*b*, may be located above the receiving formation. The normal force N is therefore transmitted to the second securing member 50 by way of the pivotable base.

FIGS. 15 and 16 show further embodiments of the invention wherein the base includes a plurality of edges being connected to the first securing member 30. This allows the securing device 10 to be exposed to forces in various directions whilst still maintaining the same functionality as described hereinbefore. The securing device of FIG. 15 can for instance be used to anchor objects to a substantially horizontal support surface.

It will be appreciated that the overriding principle in all the embodiments and configurations shown is that the force vector exerted on the securing device 10 is separated into a shear force component being substantially parallel to the supporting surface, and a tensile force being substantially perpendicular to the supporting surface. The two forces are opposed or restrained by two separate and functionally independent securing members, thus preventing the securing members from being exposed to shear and tension simultaneously, and more importantly also preventing the occurrence of peel and/or cleavage. An additional advantage is that the securing device can more easily be removed, especially in the embodiment as shown in FIG. 4.

In further examples of the invention the first securing member 30 and the second securing member 50 may be kinematically decoupled. This means that there may be limited relative displacement between certain components of the securing device, without thereby departing from the fundamental principles set out above. Firstly, limited rotation may be allowed between the upper end 22 and lower end 24 of the base 20. Functionally such rotation will be between a fulcrum line of the base 20 relative to the first securing member 30 and the second securing member 50. Similarly, there may be limited rotation between the base 20 itself and the second securing member 50. Secondly, limited translation may be allowed between the base 20 and the second securing member 50. Thirdly, there may be a combination of the above degrees of freedom (e.g. combined limited rotation and translation).

In order to optimise the functionality of the invention, the first securing member 30, as utilized in all embodiments, has specific performance characteristics, although the invention will still be effective if these characteristics are not strictly adhered to. Firstly, the body 31 is capable of distributing a pure shear loading in a substantially uniform manner over the adhesive film 32 along the length of the first securing member 30. The shear loading is caused by force S applied to the first securing member 30 in a direction parallel to a supporting surface 15. Secondly, the body 31 is stable in performing this near-uniform distribution over the life of the product, even if the loading persists continually. This consistent, near-uniform loading optimises performance of the adhesive by spreading the load over all of the adhesive on the first securing member 30, and maintains the near-uniform distribution consistently over a long period of time. In one embodiment the first securing member backing may be made of a metallic sheet that provides long term protection of the adhesive layer for extended durability of the bond under continuous high loading.

It is important that the body 20 remains stable, and thus preserves its shape, during extended long-term continuous loading so as to prevent the occurrence of cleavage and peeling on the securing members as a consequence of the body changing shape. To enable the same, the body may be made from a material with high stiffness and that does not creep significantly under long-term stress such as for instance a metal, a ceramic or carbon fibre, or it may be made from suitable composite materials. During design and experimental work it was found that the body is generally of sufficient rigidity for this particular application if the material used has a Young's modulus of at least 10 GPa (giga Pascal). If the Young's modulus is in excess of 10 GPa, it is furthermore possible to provide improved built-in characteristics in the body design, such as for example utilising a body that is substantially flat against the wall when in use. The material used must preferably have a Young's modulus of more than 20 Gpa, and more preferably in excess of 50 Gpa.

Most regular adhesive tapes have a backing of unfilled elastomeric material, which is not sufficiently stiff for the purposes of the first securing member 30. Stiffness (Young's) modulus values for unfilled elastomerics range between about 7 MPa to about 3000 MPa, and even the stiffest of these materials would stretch by more than 150 microns in a typical application of the invention. The adhesive film thickness of typical adhesive tapes range between about 20 microns and about 120 microns. It stretch of the body 31 of the first securing member 30 is limited to the thickness of the adhesive film 32, the shear strain in the adhesive does not vary excessively throughout the length of the tape.

Stretch in the body 31 of the first securing member 30, in use, is given by $$\Delta h = \tfrac{1}{2} \cdot (F/A) \cdot (h/E)$$

where

- $\Delta h$ is the amount of stretch in the body 31 of the first securing member 30,
- F is the force applied at the end of the body 31 of the first securing member 30,
- A is the cross-sectional area of the body 31 of the first securing member 30,
- h is the length of the body 31 of the first securing member 30, and
- E is the Young's modulus of the body 31 of the first securing member 30.

It has been found that if the stretch $\Delta h$ has a value no more than the thickness of the adhesive used on the first securing member 30, the first securing member 30 performs very well.

As mentioned above, another advantageous feature of this invention is that the securing device 10 can easily be removed from a supporting surface 15 without damaging the supporting surface 15. This functionality is in part a result of the configuration of the second securing member 50 relative to the first securing member 30 shown in FIG. 4. However, the composition of the second securing member 50 also contributes towards ease of removal of the securing device 10, irrespective of the securing device being of the configuration where the first securing member 30 and the second securing member are spaced apart but adjacent one another when the securing device 10 is mounted on the supporting surface 15, or the configuration where the second securing member 50 overlies and is mounted on the first securing member 30. More particularly, it was found that for the second securing member 50 to be more easily removable, it must have a backing sheet having a Young's modulus of at least 1000 MPa (mega Pascal). Preferably, the backing sheet must have a Young's modulus of more than 2000 MPa (mega Pascal). More preferably, the backing sheet must have a Young's modulus of more than 5000 MPa (mega Pascal).

It is also foreseen that, due to the characteristics identified above, the second securing member can be used independently form the first securing member to secure objects to supporting surfaces. In this application the second securing member will typically include double-sided tape as referred to above, with backing sheets as defined above provided on both sides of the double-sided tape. The backing sheets are secured to opposite sides of the double sided tape, and the other sides of the backing sheets are secured to the supporting surface and object to be secured respectively. The sandwich-like connection so formed can be assembled in any required order. A backing sheet may also be provided on only one side of the double-sided tape, as the object to be secured may for instance be secured directly to the double-sided tape.

In removing the above securing arrangement, the first step will be to cut through the body of the double sided-tape. Once the body has been separated, the backing sheets can be removed from the supporting surface and the object previously secured respectively.

Many possible uses are foreseen for the securing device described hereinbefore. The uses can primarily be categorised as permanent use (where the securing device is not intended to be removed), semi-permanent use (where the securing device may be removed at any time, but with the intention that it can also remain in place for extended periods), and temporary use (where the securing device is used for short periods such as hours or days, but at relatively high loadings).

Some specific applications include the following:

Home, Office and Workplace environment:

- Hangers for pictures, mirrors, wall-hangings, artworks;
- Mountings/hangers for small appliances such as hairdryers, intercom handsets, cellular phones and chargers therefore, mixers, power tools, air conditioning controllers;
- Pelmets, curtain supports and tie binders;
- Bathroom fittings;
- Wall-mounted bookstands and bookshelves; and
- Mounts and hangers for temporary decorations.

Industry and Commerce:

- Temporary holders and anchors for construction, assembly operations in the manufacturing industry and temporary advertising, promotional and display fittings;
- Shop decoration and fittings;
- Cable, wire and conduit bundle fixtures;
- Security anchors with integral locks; and
- Dry walling fixtures.

Other fields of industry and commerce:

- Mounts and hangers for dispensing equipment, lighting and instruments in the medical fields, including clinics;
- Mounts, hangers and anchors for maps, books, charts, radio equipment in the military fields, including mounting of objects in ships, airplanes and vehicles; and
- Temporary and/or semi-permanent road sign and traffic regulation objects; and
- Outdoor applications such as rock-climbing anchors and use in a camping environment.

it is also foreseen that the securing device can be used on non-flat surfaces such as car dashboards, car panels, pillars and lamp posts.

It will be appreciated that the above are only some embodiments of the invention, and that there may be many variations in detail without departing from the spirit and scope of the invention.

To name a few non-exhaustive examples, the receiving formation on the base may be of many different variations. In addition to those described above, the receiving formation may for instance also be in the form of a magnet, some adhesive bonding means, or any type of flexible attachment means.

The engagement between the base and the first securing member may furthermore be of any type that allows the base to pivot relative to the first securing member, such as for example a hinge connection.

The base itself may be of any suitable shape, in addition to the disclosed shapes also including T-, U-, O or X-shaped.

Yet a further variation of the Invention may provide for the second securing member to be of a multi-component structure wherein the second securing member comprises a plurality of smaller components that are linked to the base by way of interconnecting means. This configuration will be especially advantageous when the securing device is used on non-flat surfaces, as the plurality of smaller surfaces will result in a reduction of any local cleavage loading on the adhesive resulting from the use of the securing device on a non-flat surface.

The invention claimed is:

1. A securing device for use in securing an object to a supporting surface, and/or for restraining an object relative to a supporting surface, the securing device comprising:

a base being securable to the supporting surface, the base having a first region near a first end, a second region near an opposite second end, and a loading region to which a resultant force is applied when the object in use is hung from the loading region;

a first sheet-like securing member that pivotally engages the base at or near the first end of the base to form a fulcrum region, wherein the first sheet-like securing member includes an adhesive film for adhering the first sheet-like member to the supporting surface; and a second securing member affixed to the base in the second region;

wherein at least a portion of the fulcrum region presses against the supporting surface when the securing device is in use and the resultant force is applied to the loading region.

2. A securing device according to claim 1, wherein the second securing member includes an adhesive layer for adhering to the supporting surface directly and/or to the first sheet-like securing member.

3. The securing device according to claim 1 or 2, wherein the fulcrum region is positioned to result in use, with a load hanging from said loading region to produce said resultant force, in a shear stress in the first sheet-like securing member, substantially without inducing tensile stress in the first sheet-like securing member.

4. The securing device according to claim 1 or 2, wherein the fulcrum region is positioned to result in use, with a load hanging from said loading region to produce said resultant force, in loading of the second securing member with tensile stress, substantially without inducing shear stress in the second securing member.

5. The securing device according to claim 1 or 2, wherein the first end of the base pivotably engages the first sheet-like securing member at an engagement formation provided on the first sheet-like securing member.

6. The securing device according to claim 5, wherein the fulcrum region includes an edge of the first region of the base and the engagement formation is located towards an end of the first sheet-like securing member.

7. The securing device according to claim 6, wherein the engagement formation is in the form of a fold provided in the end of the first sheet-like securing member, the edge of the base being secured in the fold.

8. The securing device according to claim 6, wherein the engagement formation is in the form of a socket formation extending from the first sheet-like securing member, the edge of the base defining a spigot that pivotably engages a complimentary shaped socket.

9. The securing device according to claim 1 or 2, wherein the first sheet-like securing member includes a displacement zone for dividing the first sheet-like securing member into a primary section and a secondary section and, preventing displacement of the primary section from being transmitted to the secondary section.

10. The securing device according to claim 9, wherein the displacement zone is in the form of a pleat provided in the first sheet-like securing member.

11. The securing device according to claim 9, wherein the displacement zone is in the form of a weakened section comprising a plurality of perforations.

12. The securing device according to claim 9, wherein the displacement zone is defined by a gap between separate spaced apart primary and secondary sections, the two separate sections being interconnected by means of a bridging member.

13. The securing device according to claim 1 or 2, wherein the first sheet-like securing member includes guiding means for in use assisting a user accurately to orientate the securing device on the supporting surface.

14. The securing device according to claim 13, wherein the guiding means are in the form of apertures provided in the first sheet-like securing member.

15. The securing device according to claim 1 or 2, wherein the first sheet-like securing member includes splitting formations allowing the first sheet-like securing member to be divided into a number of sections when the first securing member is removed from the supporting surface.

16. The securing device according to claim 15, wherein the splitting formations are in the form of linear perforations and/or slits.

17. The securing device according to claim 1 or 2, wherein the first sheet-like securing member includes a high-friction surface having sufficient friction between the first sheet-like securing member and the supporting surface to aid the adhesive film in preventing the first sheet-like securing member from being displaced relative to the supporting surface when in use.

18. The securing device according to claim 1 or 2, wherein the first sheet-like securing member and the second securing member are spaced apart when mounted on the supporting surface.

19. The securing device according to claim 1 or 2, wherein the second securing member overlies the first sheet-like securing member in order for the second securing member to be mountable on the first sheet-like securing member, and for the first securing member to be mountable on the supporting surface.

20. The securing device according to claim 9, wherein the second securing member is mountable on the secondary section of the first sheet-like securing member.

21. The securing device according to claim 1 or 2, wherein the loading region includes a receiving formation for receiving the object.

22. The securing device according to claim 1 or 2, wherein the loading region includes attachment means for attaching the object and the base to one another.

23. The securing device according to claim 21, wherein the receiving formation is defined by an upper edge of the base.

24. The securing device according to claim 1 or 2, wherein in use, with a load hanging from said loading region to produce said resultant force, an amount by which the first sheet-like securing member stretches under the loading of the resultant force resulting from a maximum securing device design load, is smaller than a thickness of the adhesive film of the first sheet-like securing member.

25. The securing device according to claim 24, wherein in use, with a load hanging from said loading region to produce said resultant force, the amount by which the first sheet-like securing member stretches is smaller than half the thickness of the adhesive film of the first sheet-like securing member.

26. The securing device according to claim 25, wherein in use, with a load hanging from said loading region to produce said force, the amount by which the first sheet-like securing member stretches is smaller than a quarter of the thickness of the adhesive film of the first sheet-like securing member.

* * * * *